US010040311B2

(12) United States Patent
Medhin

(10) Patent No.: US 10,040,311 B2
(45) Date of Patent: Aug. 7, 2018

(54) ANGLED PEN

(71) Applicant: Michael S. Medhin, Alexandria, VA (US)

(72) Inventor: Michael S. Medhin, Alexandria, VA (US)

( * ) Notice: Subject to any disclaimer, the term of this patent is extended or adjusted under 35 U.S.C. 154(b) by 59 days.

(21) Appl. No.: 15/162,846

(22) Filed: May 24, 2016

(65) Prior Publication Data

US 2017/0341457 A1 Nov. 30, 2017

(51) Int. Cl.

| | |
|---|---|
| ***B43K 5/00*** | (2006.01) |
| ***B43K 7/00*** | (2006.01) |
| ***B43K 23/004*** | (2006.01) |
| ***B43K 23/08*** | (2006.01) |
| ***B43K 23/12*** | (2006.01) |

(52) U.S. Cl.

CPC ..... *B43K 5/005* (2013.01); *B43K 7/00* (2013.01); *B43K 7/005* (2013.01); *B43K 23/004* (2013.01); *B43K 23/08* (2013.01); *B43K 23/12* (2013.01)

(58) Field of Classification Search

CPC . B43K 7/00; B43K 7/02; B43K 7/005; B43K 7/10; B43K 5/04; B43K 5/005; B43K 8/003

See application file for complete search history.

(56) References Cited

U.S. PATENT DOCUMENTS

| | | | | |
|---|---|---|---|---|
| 3,352,621 | A | 11/1967 | Fehling et al. | |
| 4,679,954 | A | 7/1987 | Ambasz | |
| D311,211 | S | 10/1990 | Oot | |
| 5,012,663 | A | 5/1991 | Brown | |
| 5,172,994 | A | 11/1992 | Brown | |
| D345,579 | S | 3/1994 | Yanez, Jr. | |
| 5,527,124 | A | 6/1996 | Kolaric | |
| 5,564,849 | A | 10/1996 | Greer, Jr. | |
| 5,988,921 | A | 11/1999 | Medhin | |
| 6,250,828 | B1 * | 6/2001 | Liu | B43K 5/005 401/195 |
| 7,665,921 | B2 * | 2/2010 | Liu | B43K 5/005 401/17 |

FOREIGN PATENT DOCUMENTS

| | | |
|---|---|---|
| DE | 9000724 | 4/1990 |
| FR | 1253384 | 2/1961 |
| GB | 222374 | 10/1924 |
| WO | 91/16210 | 10/1991 |

* cited by examiner

*Primary Examiner* — David Walczak

(74) *Attorney, Agent, or Firm* — Andrew M. Calderon; Roberts Mlotkowski Safran Cole & Calderon, P.C.

(57) ABSTRACT

A pen includes: a shank; an ink tube inside the shank; a first tip member connected to a distal end of the shank; a second tip member connected to a distal end of the first tip member; and a bent tubular member including a proximal end section, a middle section, and a distal end section. An axis of the middle section is arranged at a first angle relative to a central axis of the shank. The axis of the middle section is arranged at a second angle relative to an axis of the distal end section, the second angle being in a range of 45° to 90° . The axis of the distal end section is arranged at a third angle relative to the central axis of the shank.

8 Claims, 20 Drawing Sheets

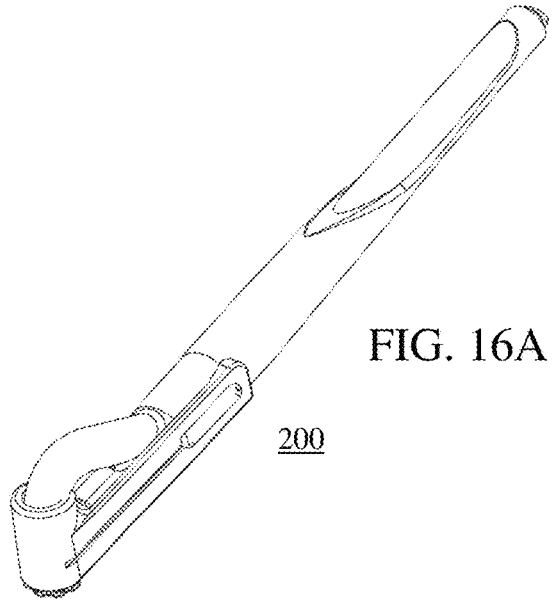
FIG. 16A
FIG. 16B
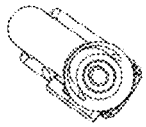
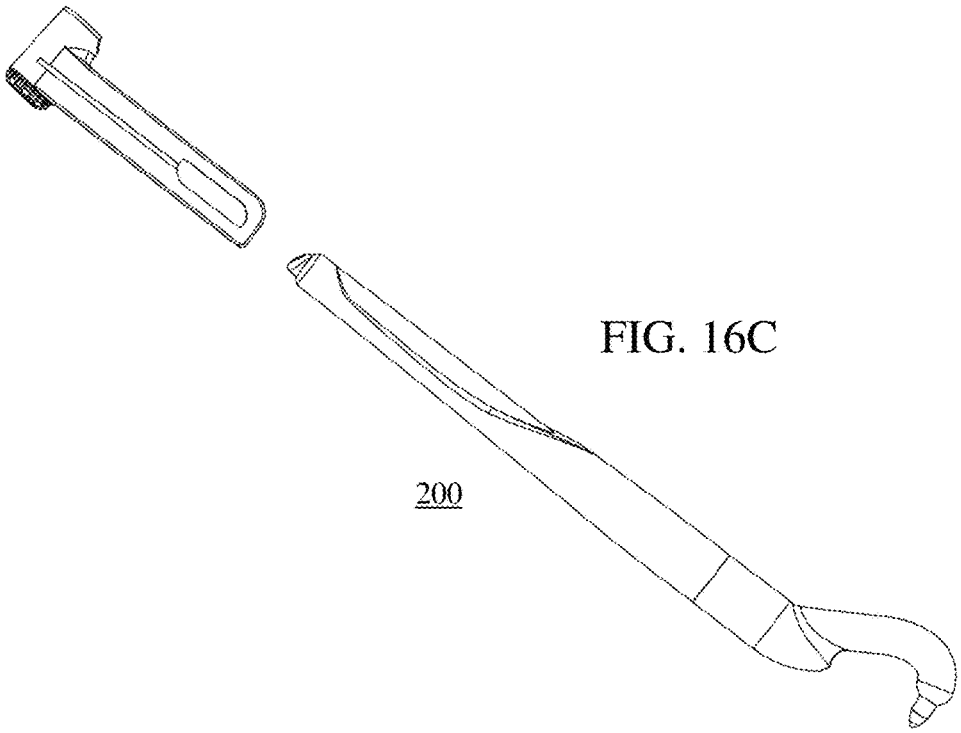
FIG. 16C

ANGLED PEN

FIELD OF THE INVENTION

The invention generally relates to the field of writing utensils and, more particularly, to angled pens for alleviating poor posture during writing.

BACKGROUND

Many written languages, such as English, are read from left to right and written in the same direction. To write in such a language, a person holding a pen in their right hand (e.g., a right hander) drags the pen from left-to-right across a writing surface (e.g., a piece of paper). In contrast, a person writing with a pen in their left hand (e.g., a left hander) pushes the pen from left-to-right across the writing surface. The natural position of the pen in the left hand causes the pen to be inclined into the paper in the direction of writing and consequently aligns the pressure being exerted by the left hand against the paper with the direction of movement. This contrasts with a right-hander whose writing pressure is directed opposite the direction of movement across the page. These facts thus present a number of problems for a person holding a pen in their left hand while writing from left to right.

Similar problems may exist for a person holding a pen in their right hand while writing from right to left. There are a number of languages that are written in the right to left direction, including: Arabic script, Hebrew alphabet, Syriac alphabet, Samaritan alphabet, Mandaic alphabet, Thaana, Mende Kikakui, N'Ko script, and Adlam. A right handed person holding a pen in their right hand and pushing the pen from right to left across a written page will experience the same problems as a left handed person holding a pen in their left hand and pushing the pen from left to right across the written page.

For example, as a pen is pushed by a left hand in a left-to-right writing direction, the left hand may be dragged across the face of the newly inked paper, causing it to smear. This is a function of the left-to-right direction of travel of the pen relative to the page. Moreover, the inclination of the pen against the paper, i.e., the left hand pushing the pen into the paper while holding the pen in the natural position, causes the tip of the pen to be jammed into the paper, which may cause the paper to rip. To avoid these problems, a left hander often compensates by repositioning one or more of their torso, arm, wrist, and fingers relative to place the pen at a desired angle relative to the writing surface. This physical repositioning comes at a cost to the writer, however, in the form of aches, pain, poor posture, and even carpal tunnel syndrome in prolonged cases.

Pens specifically designed for left handed writers are known in the art. For example, U.S. Pat. No. 5,988,921 issued to the same inventor, discloses an embodiment in which only the tip of a pen is angled. It has been found that this arrangement creates an off-center pivot point and places the pen out of alignment with the central axis that is naturally present in writing instruments, making the pen somewhat uncomfortable and difficult to use.

SUMMARY

An object of the invention is to empower writers with the best most mechanically sound writing position possible while maintaining an ergonomic hand and body position. Attempting to drag the tip of the writing point across (instead of pushing it into) the writing surface is the main reason why left handers contort their body, arm, and wrist when using conventional pens. In contrast to conventional pens, pens in accordance with aspects of the invention help left handers avoid having to contort their wrist, arm and body to find a drag position of the point. In embodiments, the writing point of the pen is coincident with a center line of symmetry of the handle, shank, or hand held part of the pen. Keeping the symmetry of the body and the pen prevents creating an off-center pivot point that makes it difficult or uncomfortable for the writer to maintain balance of the writing utensil. In embodiments, when the inventive pen is held in a user's left hand, a center line of the conical tip of the pen is at an angle between 90 and 45 degrees with the writing surface leaning to the right of a vertical plane, while having the writing tip of the pen on the same symmetrical line as the handle of the pen. Conversely, when the inventive pen is held in a user's right hand, a center line of the conical tip of the pen is at an angle between 90 and 45 degrees with the writing surface leaning to the left of a vertical plane, while having the writing tip of the pen on the same symmetrical line as the handle of the pen. To accomplish this arrangement, the conical tip of the pen forms an angle in the opposite direction of the shank.

In an aspect of the invention, there is a pen including: a shank; an ink tube inside the shank; a first tip member connected to a distal end of the shank; a second tip member connected to a distal end of the first tip member; and a bent tubular member including a proximal end section, a middle section, and a distal end section. An axis of the middle section is arranged at a first angle relative to a central axis of the shank. The axis of the middle section is arranged at a second angle relative to an axis of the distal end section, the second angle being in a range of 45° to 90°. The axis of the distal end section is arranged at a third angle relative to the central axis of the shank.

In another aspect of the invention, there is a pen including: a shank comprising a straight section and a bent section; a tip member connected to a distal end of the shank; an ink tube inside the straight section of the shank and the bent section of the shank, wherein a distal end of the ink tube passes through a first internal bore of the tip member; and a bent tubular member comprising: a proximal end section connected to the distal end of ink tube; a distal end section comprising a writing tip; and a bend between the proximal end section and the distal end section, wherein the proximal end section is angled relative to the distal end section by an angle of 45 to 90 degrees.

In another aspect of the invention, there is a pen including: a shank; an ink tube or ink reservoir inside the shank; and a bent tubular member comprising a proximal end section, a middle section, and a distal end section. The proximal end section of the bent tubular member is connected directly to the distal end of the shank. A writing tip is at the distal end section of the bent tubular member. An axis of the middle section of the bent tubular member is arranged at a first angle relative to a central axis of the shank. The axis of the middle section of the bent tubular member is arranged at a second angle relative to an axis of the distal end section of the bent tubular member, the second angle being in a range of 45° to 90°. The axis of the distal end section of the bent tubular member is arranged at a third angle relative to the central axis of the shank.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

FIGS. 13-15 and 16A-J show another pen in accordance with aspects of the invention.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention generally relates to the field of writing utensils and, more particularly, to angled pens for alleviating poor posture during writing. According to aspects of the invention, a pen includes a tubular shank, a lid, an ink tube, a conical tip which contains a ballpoint, and a tubular part shaped to direct the tip and form an angle that directs the point about 45 degrees from the writing surface and forms about a 90 degree angle with the tubular shank.

In embodiments, the tubular part contains the ink that flow from the tubular shank to the tip of the pen. The tubular part may include a connecting rod or tube. In a preferred embodiment to aid with ink flow, the pen is sized and shaped such that the tube is parallel to or angled downward relative to the writing surface when the pen is held in a hand for writing on the writing surface. In some embodiments, a one-way valve is incorporated in the ink flow path to permit ink flow toward the tip of the pen and prevent back flow of ink. In some embodiments, pressurized gas is utilized to prevent back flow of ink.

Implementations of the invention advantageously permit the pen to be held in a left hand for writing left to right (or held in a right hand for writing right to left) and have the writing tip be angled away from the shank without creating an off-center pivot point. In embodiments, the center line of the hand held portion of the pen remains in line with the writing tip while the writing tip is leaning away from the handle, thereby allowing the pen to function as if it was being held by the other hand and eliminating the need for contorting the body to reposition the writing tip to achieve the desired angle.

Figure 1:
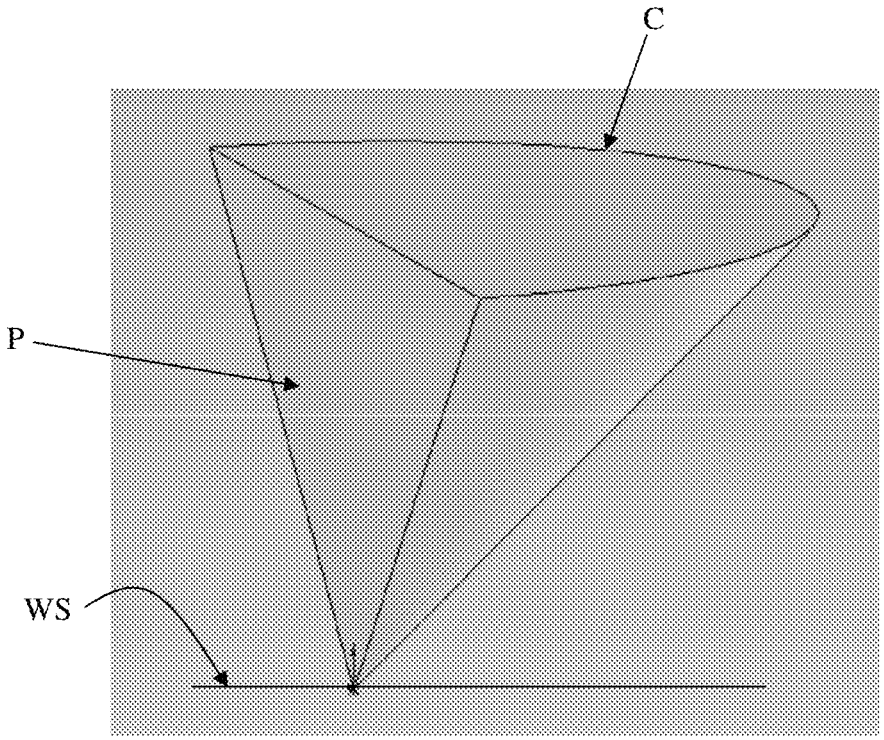
FIG. 1 shows a volume of preferred angles in accordance with aspects of the invention.

FIG. 1 shows half of a cone "C" that is on the right side of the page or in the direction of the written word and the point at the bottom is where the point of a writing utensil will come in contact the writing surface "WS". To avoid the noted problems associated with pushing the writing tip of the pen into the page when holding the pen in the left hand and writing from left to right, the best writing position results when the writing tip of the pen is in the range of angles formed on the right side of a plane "P" that bisects the cone and is perpendicular to the writing surface. The opposite half-cone (not shown) is optimal when holding the pen in the right hand and writing from right to left. It is within this range of angles defined by the bisected cone that will result in the writing tip of the pen being dragged across the writing surface, rather than being pushed into the writing surface.

Figure 2:
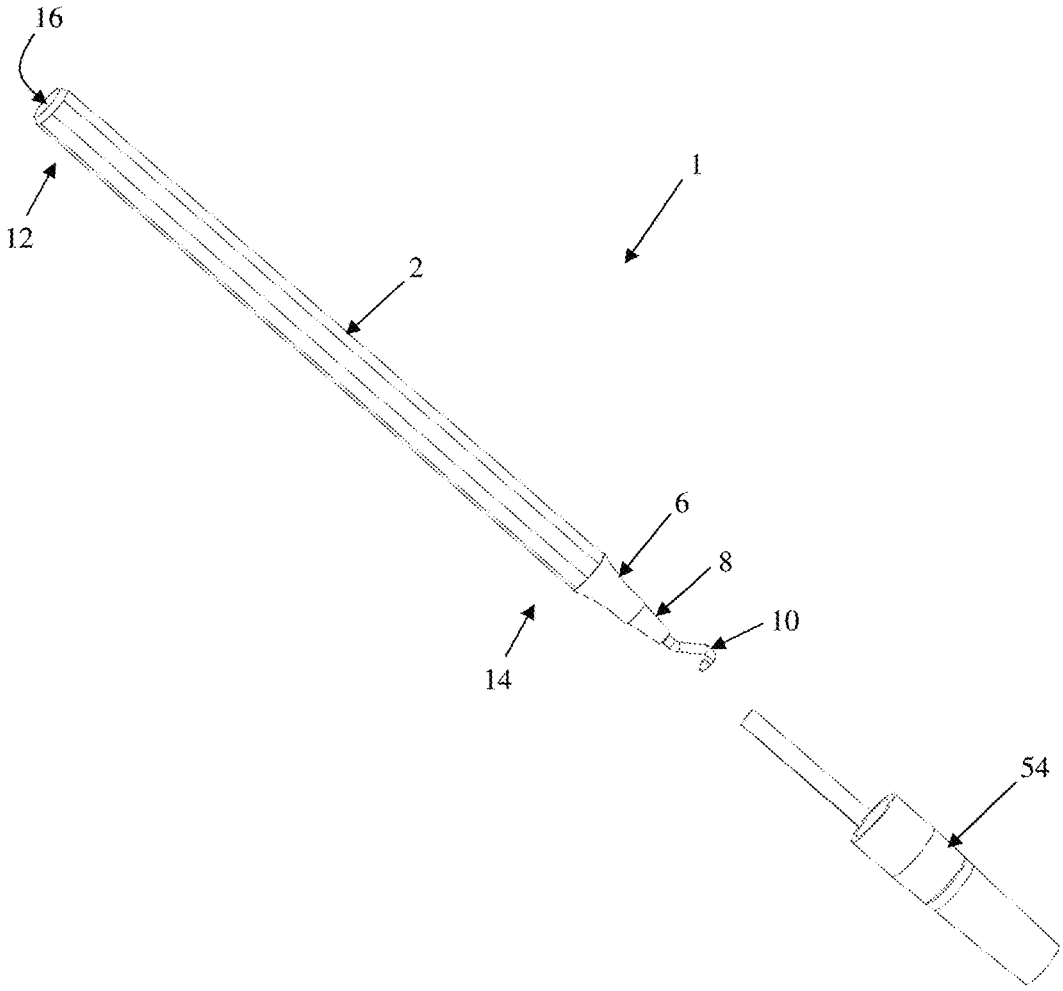
FIGS. 2-5, 6A-C, and 7A-I show a pen in accordance with aspects of the invention.
Figure 3:
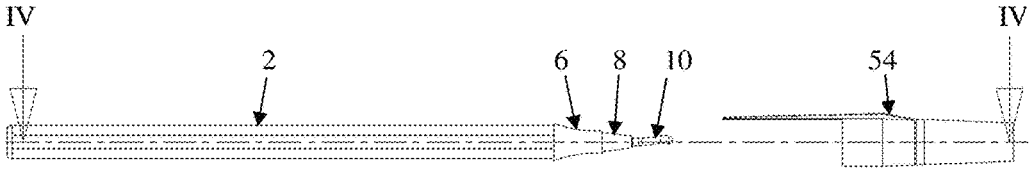
Figure 4:
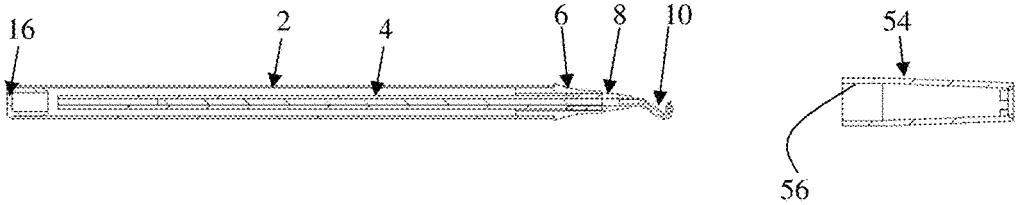
Figure 5:
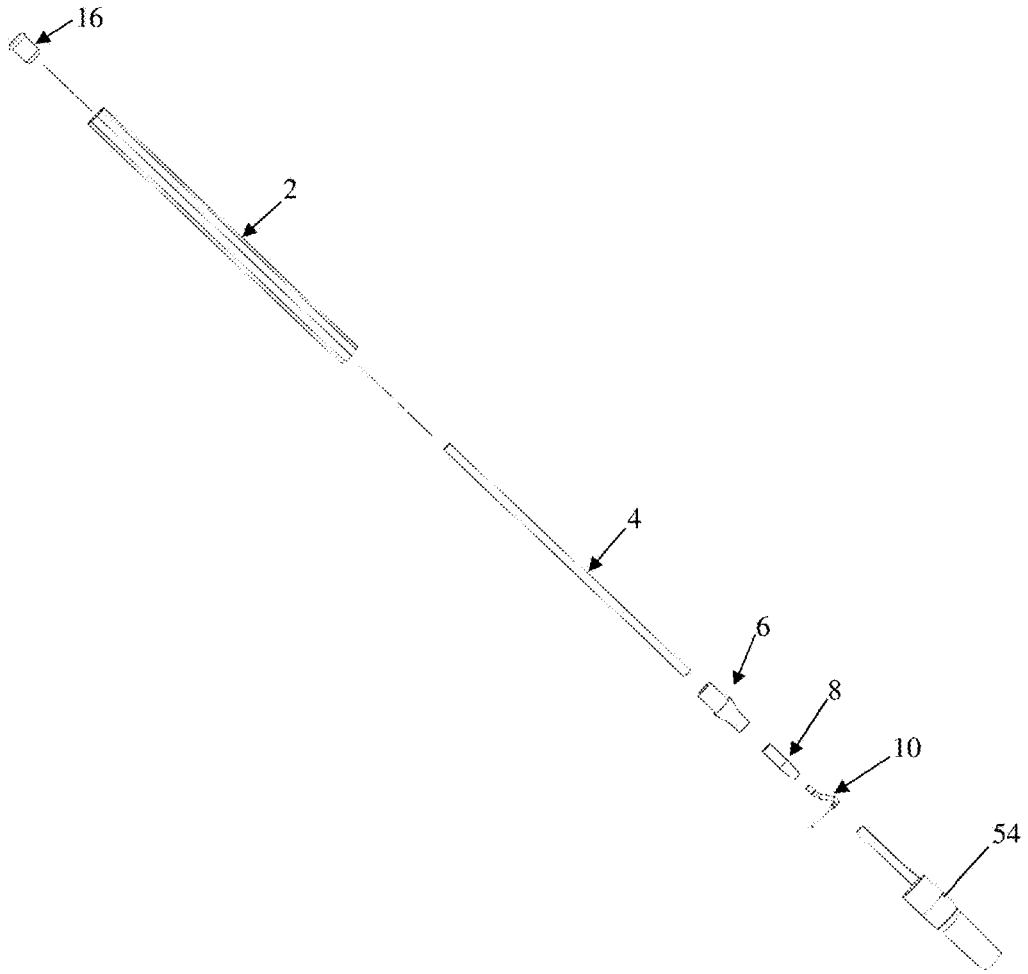
Figure 6A:
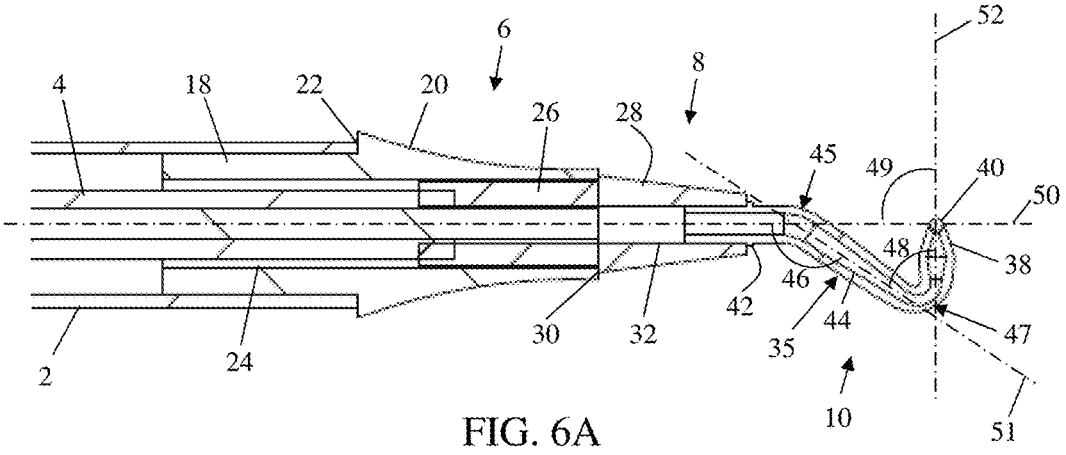
Figure 7A:
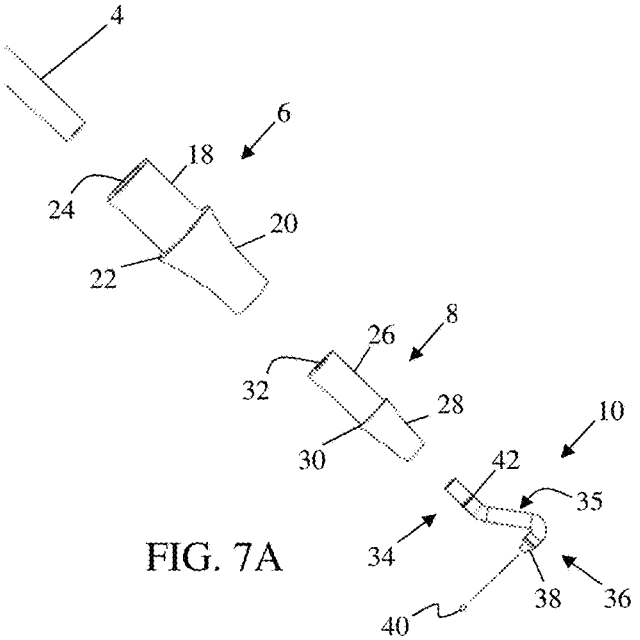

FIGS. 2-5, 6A-C, and 7A-I show a first pen 1 in accordance with aspects of the invention. Specifically, FIGS. 2 and 3 show respective views of the pen 1. FIG. 4 is a cross sectional view along line IV-IV of FIG. 3. FIG. 5 is an exploded view of the pen 1. FIG. 6A is an enlarged view showing details of a portion of FIG. 4, and FIG. 7A is an enlarged view showing details of a portion of FIG. 5. FIGS. 7B-I show additional views of a design of the pen 1.

Now referring to FIGS. 2-5, 6A-C, and 7A-I, the pen 1 includes a shank 2, an ink tube 4, a first tip member 6, a second tip member 8, and a bent tubular member 10. In embodiments, the shank 2 comprises a hollow, tubular shaped body with a proximal end 12 and a distal end 14. A plug 16 may be located and connected in the proximal end 12 of the shank 2, e.g., by friction fit or screw thread.

In embodiments, the first tip member 6 comprises a stem 18 and a conical portion 20. The stem 18 is structured and arranged to fit inside the distal end 14 of the shank 2, e.g., by friction fit or screw thread. The stem 18 may have a cylindrical external shape corresponding to the cylindrical internal bore of the shank 2. In embodiments, the first tip member 6 comprises a shoulder 22 between the stem 18 and conical portion 20, and the shoulder 22 abuts directly against the distal end 14 of the shank 2 when the first tip member 6 is connected to (e.g., inserted in) the shank 2. The first tip member 6 includes an internal bore 24.

In embodiments, the second tip member 8 comprises a stem 26 and a conical portion 28. The stem 26 is structured and arranged to fit inside the bore 24 of the first tip member 6, e.g., by friction fit. The stem 26 may have a cylindrical external shape corresponding to the cylindrical internal bore 24 of the first tip member 6. In embodiments, the second tip member 8 comprises a shoulder 30 between the stem 26 and conical portion 28, and the shoulder 30 abuts directly against a distal end of the first tip member 6 when the second tip member 8 is connected to (e.g., inserted in) the first tip member 6. The second tip member 8 includes an internal bore 32.

In embodiments, the bent tubular member 10 comprises a hollow tubular structure having a proximal end 34, a middle section 35, and a distal end 36. The proximal end 34 is structured and arranged to fit inside the bore 32 of the second tip member 8, e.g., by friction fit. The proximal end 34 may have a cylindrical external shape corresponding to the cylindrical internal bore 32 of the second tip member 8. The distal end 36 comprises a socket 38 that holds a ball 40 in a conventional manner. In embodiments, the bent tubular member 10 comprises a shoulder 42 between the proximal end 34 and the distal end 36, and the shoulder 42 abuts directly against a distal end of the second tip member 8 when the bent tubular member 10 is connected to (e.g., inserted in) the second tip member 8. The bent tubular member 10 includes an internal passage 44.

The ink tube 4 is a tubular member with an internal cavity that is used to store ink for delivering to the socket 38 and ball 40 at the writing tip of the bent tubular member 10. In embodiments, a distal end of the ink tube 4 is arranged inside the internal bore 24 of the first tip member 6 and connected to the stem 26 of the second tip member 8. In this manner, the internal cavity of the ink tube 4 is placed in fluidic communication with the internal passage 44 of the bent tubular member 10 via the internal bore 32 of the second tip member 8. In this manner, ink may flow from the ink tube 4 to the socket 38 and ball 40 at the writing tip of the bent tubular member 10.

Figure 6B:
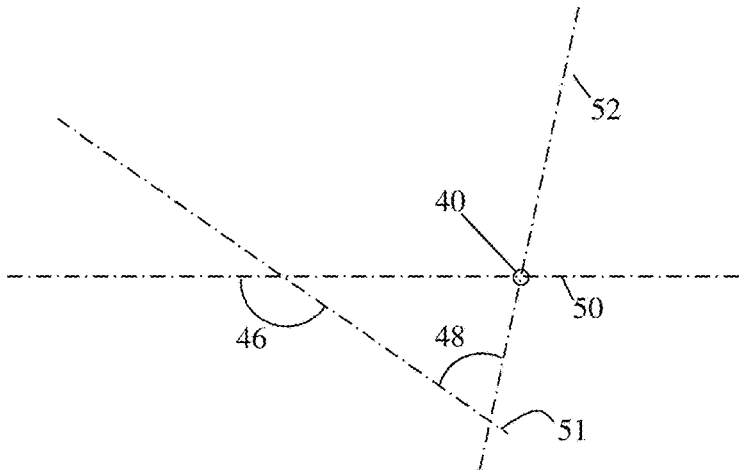
Figure 6C:
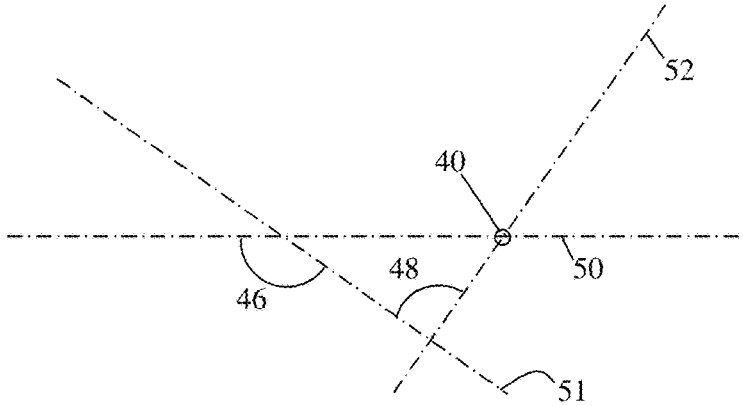
Figure 7B:
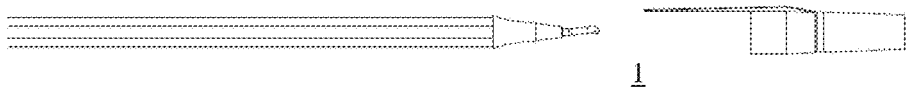
Figure 7C:
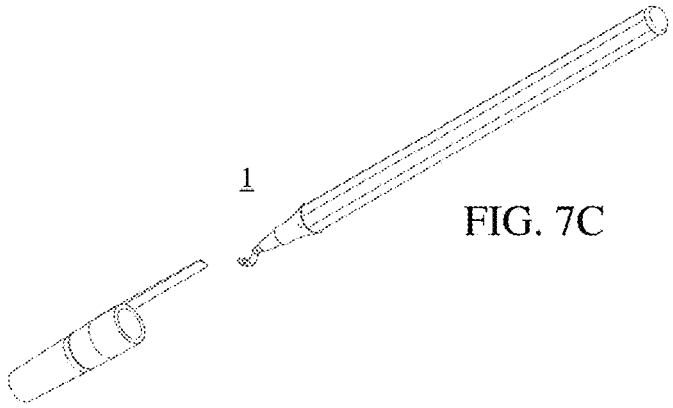
Figure 7D:
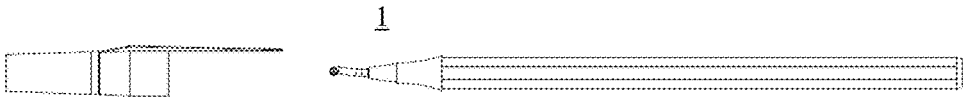
Figure 7E:
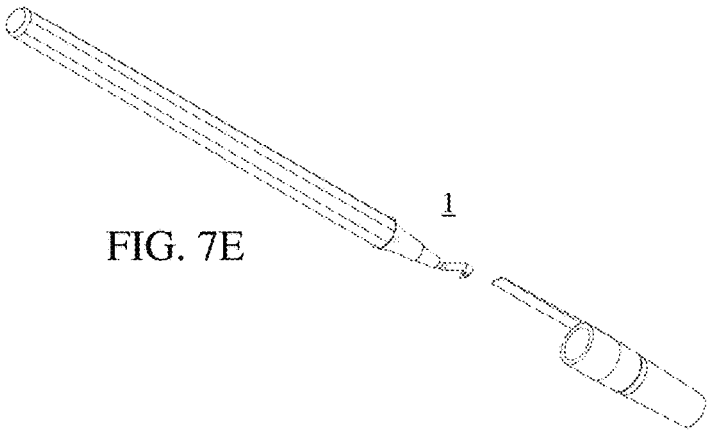
Figure 7F:
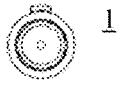
Figure 7G:
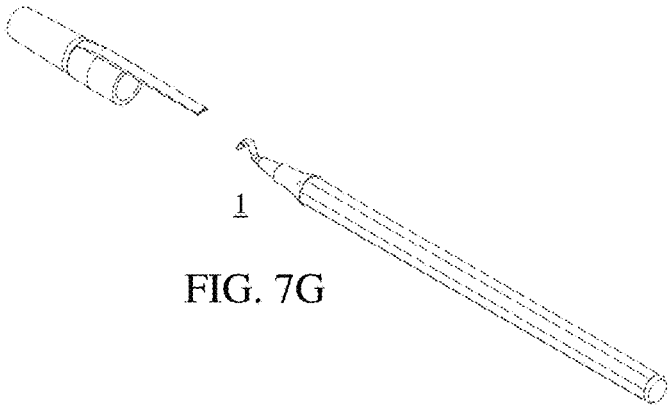
Figure 7I:
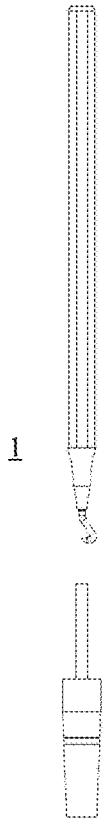
Figure 7H:
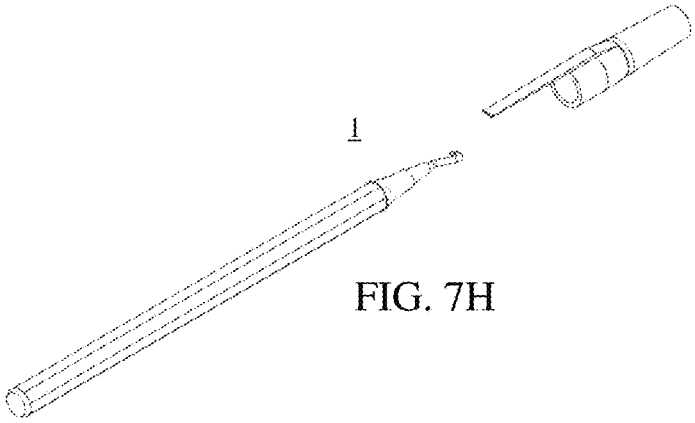

In accordance with aspects of the invention, the bent tubular member 10 comprises a first bend 45 that defines a first angle 46 and a second bend 47 that defines a second angle 48. The first bend 45 and the second bend 47 are between the proximal end 34 and the distal end 36. In embodiments, the shank 2, the first tip member 6, the second tip member 8, and the proximal end 34 of the bent tubular member 10 are all coaxially arranged along a central longitudinal axis 50. The middle section 35 of the bent tubular member 10 has a central axis 51. The distal end 36 of the bent tubular member 10 has a central axis 52. According to aspects of the invention, the bend 45 is structured and arranged such that the angle 46 defined between axis 50 and axis 51 (as shown in FIG. 6A) is greater than 90° and preferably in a range of 115° to 150°, and most preferably in a range of 135° to 150°. According to aspects of the invention, the bend 47 is structured and arranged such that the angle 48 defined between axis 51 and axis 52 (as shown in FIG. 6A) is in a range of 45° to 90°, and preferably in a range of 45° to 67.5°. In the exemplary embodiment shown in FIG. 6A, the angle 46 is about 146°, the angle 48 is about 56°, and the angle 49 is about 90°. FIG. 6B schematically shows another exemplary embodiment in which the angle 46 is about 145° and the angle 48 is about 67.5°. FIG. 6C schematically shows another exemplary embodiment in which the angle 46 is about 145° and the angle 48 is about 90°. Unless otherwise noted, all values of angles disclosed herein have a tolerance of plus or minus 2 degrees. By configuring the pen 1 such that the angle 48 is about 45 to 90 degrees, a user holding the pen 1 in their left hand may position the writing tip relative to the writing surface in the half cone described with respect to FIG. 1.

In accordance with aspects of the invention, the bends 45, 47 and angles 46, 48 are structured and arranged such that the ball 40 is located on or very close to (e.g., within 1 to 2 mils of) the central longitudinal axis 50, e.g., as shown in each of FIGS. 6A, 6B, and 6C. By configuring the pen 1 such that the ball 40 is on (or very close to) the axis 50, the problem of an off-center pivot is avoided. As such, implementations of the pen 1 permit a left handed user to drag the writing tip across the writing surface when writing from left to right with the pen in their left hand (positioning the tip for the preferred drag direction), as opposed to pushing the writing tip into the paper as is the case when writing in the same manner using a conventional pen. The same pen can be used to achieve a dragging motion (instead of a pushing motion) for a right handed person holding the pen in their right hand and moving the pen in a right to left direction across the page.

Accordingly, in a preferred embodiment, the pen 1 includes the bent tubular member 10 connected to a distal end of the second tip member 8. The distal end section 36 of the bent tubular member 10, comprising a writing tip such as ball 40. An axis 51 of the middle section 35 is arranged at a first angle 46 relative to a central axis 50 of the shank 2. The axis 51 of the middle section 35 is arranged at a second angle 48 relative to an axis 52 of the distal end section 36, the second angle being in a range of 45° to 90°. The axis 52 of the distal end section 36 is arranged at a third angle 49 relative to the central axis 50 of the shank 2. In a preferred embodiment, all angles 46, 48, 49 are non-zero angles, and the first angle 46 is greater than the second angle 48.

In embodiments, and as shown in FIGS. 2-6A, the ink tube 4 is straight without any bends, and the bent tubular member 10 has two bends 45, 47. In embodiments, the bends 45, 47 are located outside of the shank 2, outside of the first tip member 6, and outside of the second tip member 8.

Still referring to FIGS. 2-5 and 7B-I, the pen 1 may include a cap 54 that is sized to fit over both the proximal end 12 and the distal end 14 of the shank 2. In embodiments, the cap 54 has a cylindrical internal bore 56 that is slightly larger than the exterior dimension of the distal end 14 of the shank 2, such that the cap 54 may be snugly secured on the distal end 14 of the shank 2 by friction fit. According to aspects of the invention, the bent tubular member 10 is sized to fit within the cylindrical internal bore 56 of the cap 54, such that the bent tubular member 10 is completely covered by the cap 54 when the cap 54 is frictionally connected to the distal end 14 of the shank 2.

Figure 8:
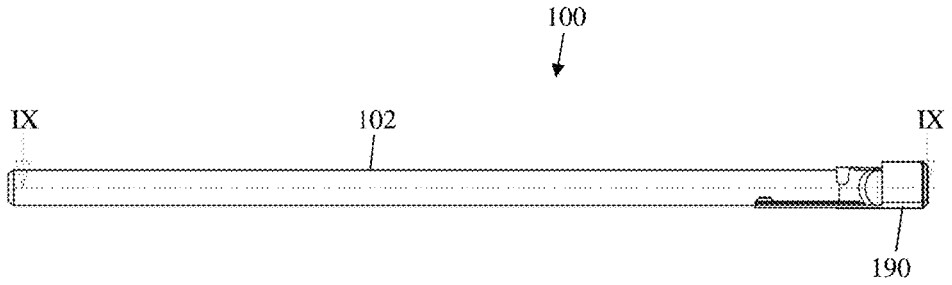
FIGS. 8-11 and 12A-I show another pen in accordance with aspects of the invention.
Figure 9:
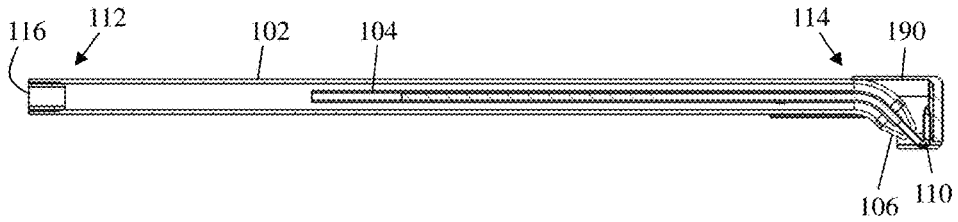
Figure 10:
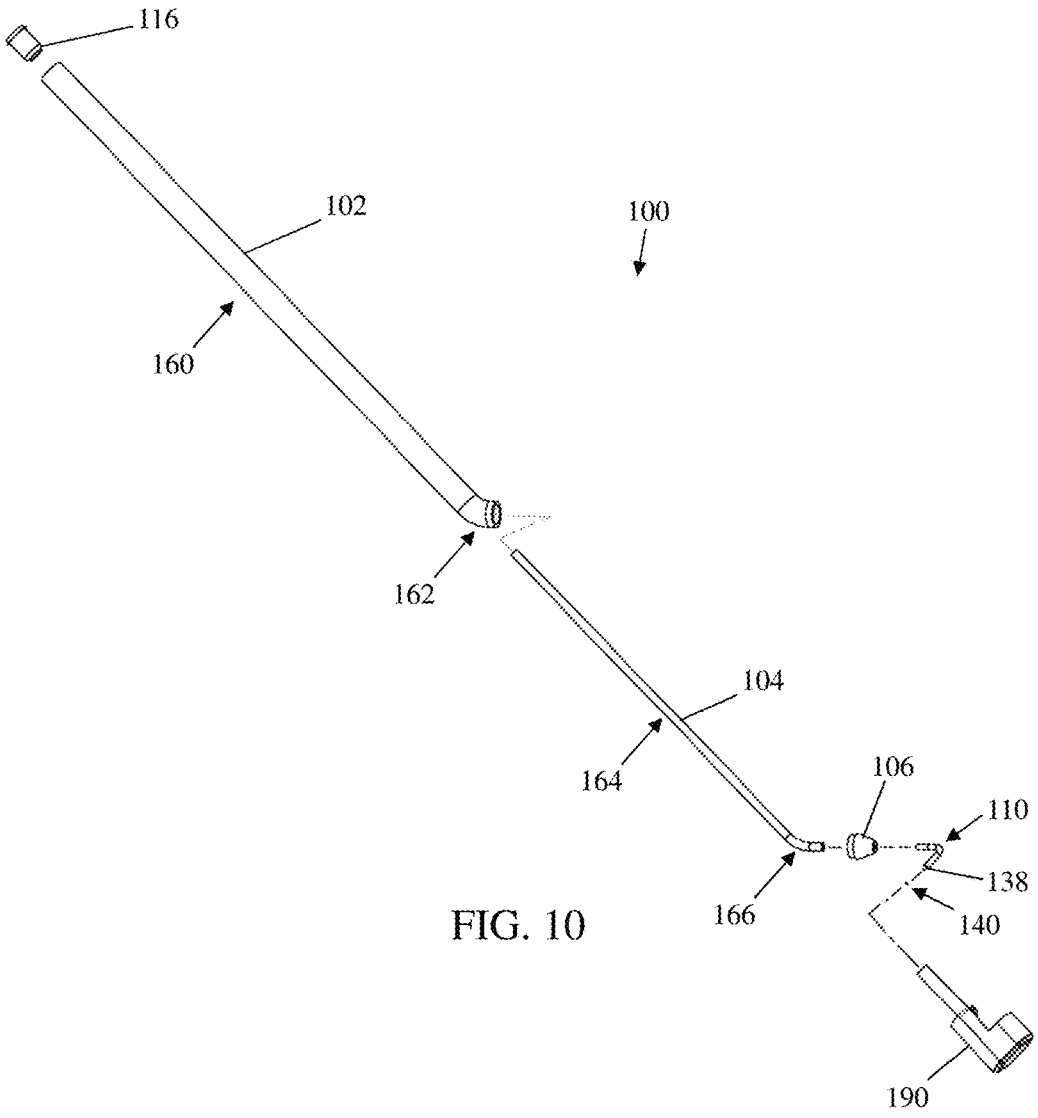
Figure 11:
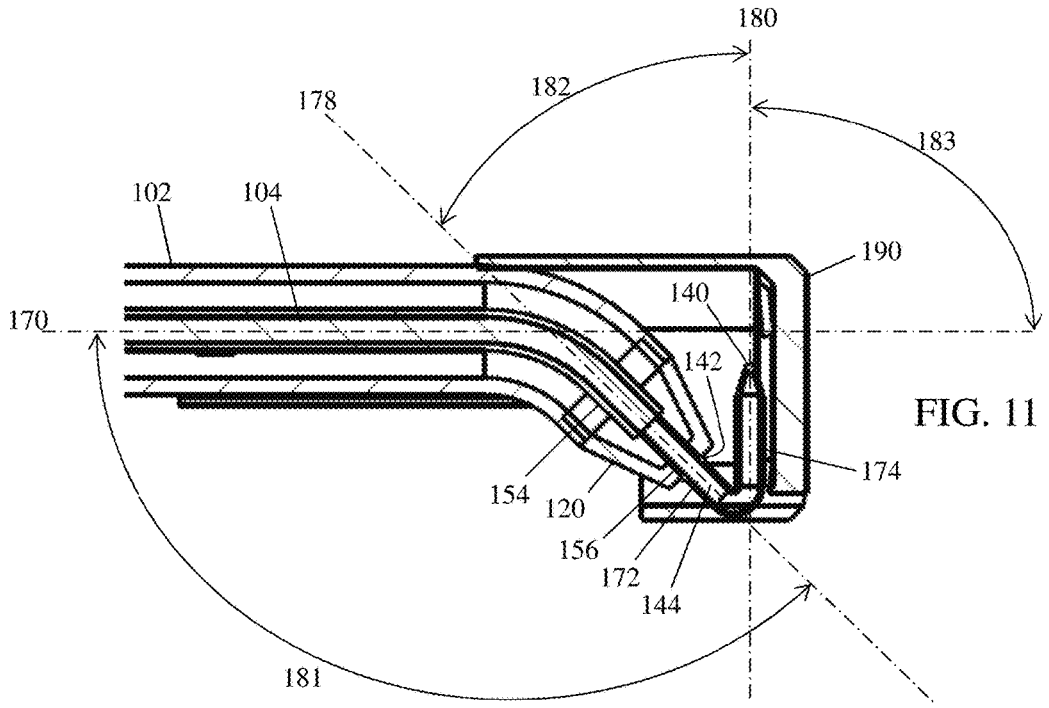
Figure 12A:
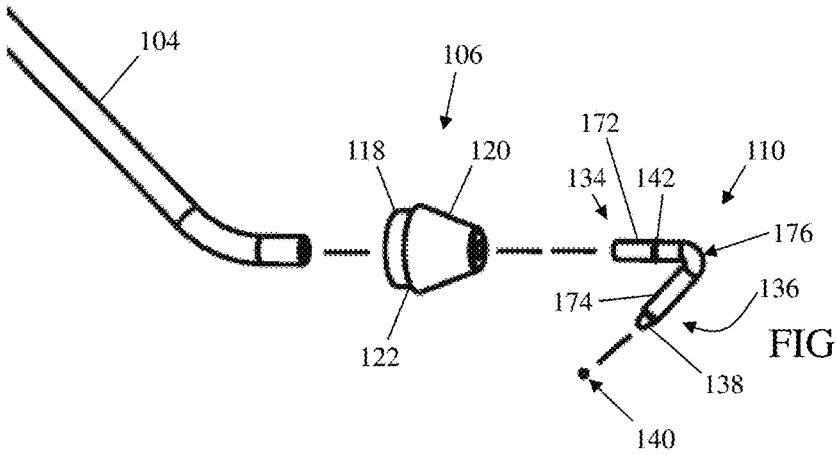
Figure 12B:
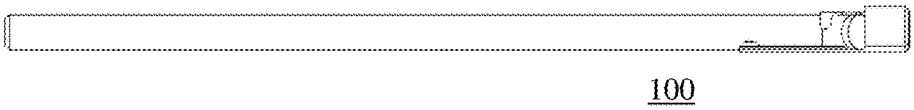
Figure 12C:
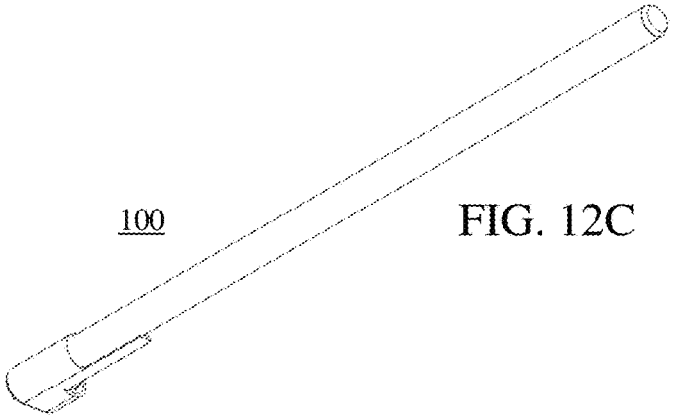
Figure 12D:
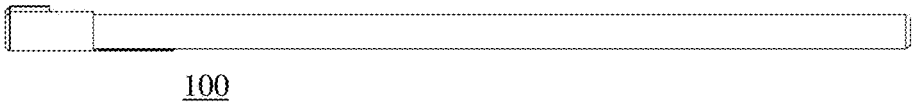
Figure 12E:
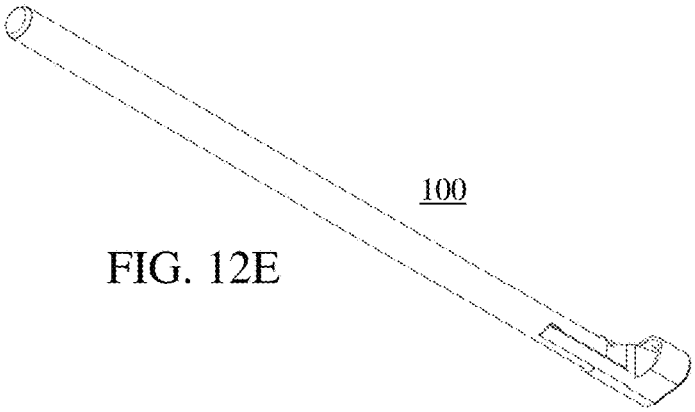
Figure 12F:
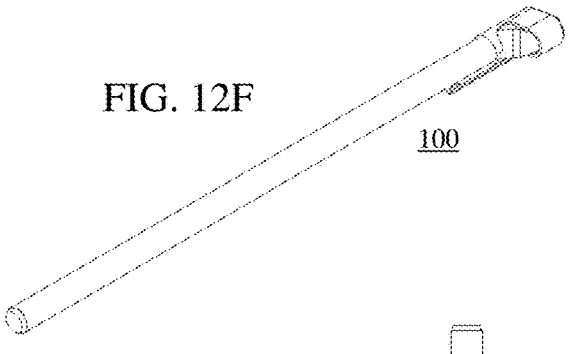
Figure 12G:
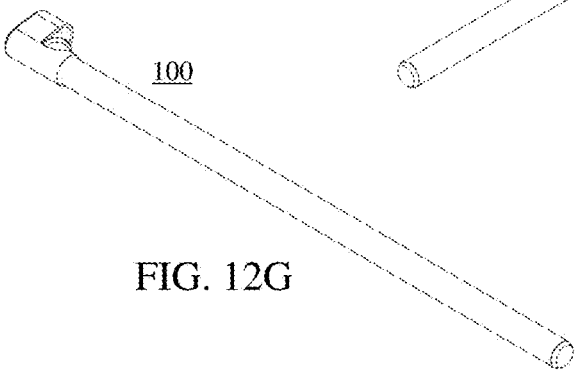
Figure 12I:
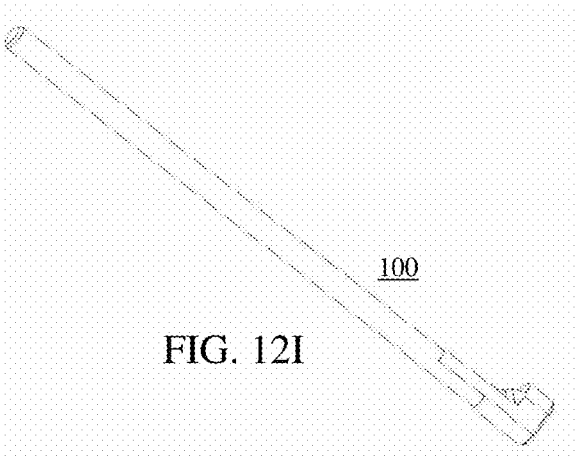
Figure 12H:
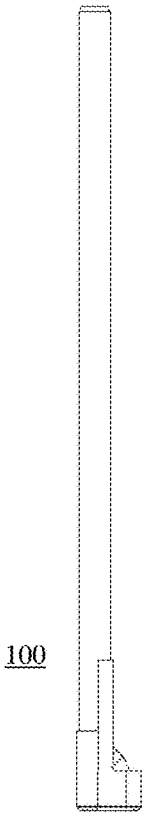

FIGS. 8-11 and 12A-I show another embodiment of a pen 100 in accordance with aspects of the invention. FIG. 8 shows a view of the pen 100. FIG. 9 is a cross sectional view along line IX-IX of FIG. 8. FIG. 10 is an exploded view of the pen 100. FIG. 11 is an enlarged view showing details of a portion of FIG. 9, and FIG. 12A is an enlarged view showing details of a portion of FIG. 10. FIGS. 12B-I show additional views of a design of the pen 100.

Now referring to FIGS. 8-11 and 12A-I, the pen 100 includes a shank 102, an ink tube 104, a tip member 106, and a bent tubular member 110. In embodiments, the shank 102 comprises a hollow, tubular shaped body with a proximal end 112 and a distal end 114. A plug 116 may be located and connected in the proximal end 112 of the shank 102, e.g., by friction fit or screw thread.

In embodiments, the tip member 106 comprises a stem 118 and a conical portion 120. The stem 118 is structured and arranged to fit inside the distal end 114 of the shank 102, e.g., by friction fit or screw thread. The stem 118 may have a cylindrical external shape corresponding to the cylindrical internal bore of the shank 102. In embodiments, the tip member 106 comprises a shoulder 122 between the stem 118 and conical portion 120, and the shoulder 122 abuts directly against the distal end 114 of the shank 102 when the tip member 106 is connected to (e.g., inserted in) the shank 102.

In embodiments, the bent tubular member 110 comprises a hollow tubular structure having a proximal end 134 and a distal end 136. The distal end 136 comprises a socket 138 that holds a ball 140 in a conventional manner. In embodiments, the bent tubular member 110 comprises a shoulder 142 between the proximal end 134 and the distal end 136, and the shoulder 142 abuts directly against a distal end of the tip member 106 when the bent tubular member 110 is inserted in the tip member 106. The bent tubular member 110 includes an internal passage 144.

The ink tube 104 is a tubular member with an internal cavity that is used to store ink for delivering to the socket 138 and ball 140 at the writing tip of the bent tubular member 110. In embodiments, the proximal end 134 of the bent tubular member 110 is received in an internal bore of a distal end of the ink tube 104. In this manner, the internal cavity of the ink tube 104 is placed in fluidic communication with the internal passage 144 of the bent tubular member 110. In this manner, ink may flow from the ink tube 104 to the socket 138 and ball 140 at the writing tip of the bent tubular member 110.

In embodiments, the tip member 106 includes a first internal bore 154 in the stem 118 and a second internal bore 156 in the conical portion 120. In accordance with aspects of the invention, the first internal bore 154 has a diameter that is slightly larger than an outer diameter of a distal end of the ink tube 104 such that the distal end of the ink tube 104 is received in and held in the first internal bore 154, e.g., by friction fit. In embodiments, the proximal end 134 of the bent tubular member 110 passes through the second internal bore 156 and is received in the internal bore of the distal end of the ink tube 104. The inner diameter of the internal bore of the distal end of the ink tube 104 and the outer diameter of the proximal end 134 of the bent tubular member 110 may be configured such that the proximal end 134 of the bent tubular member 110 is held by friction fit in the internal bore of the distal end of the ink tube 104. As shown in the figures, the connection between the distal end of the ink tube 104 and the proximal end of the bent tubular member 110 may be located in a space between the first internal bore 154 in the stem 118 and the second internal bore 156 in the conical portion 120.

According to aspects of the invention, the shank 102 comprises a straight section 160 and a bent section 162, with the bent section 162 being at the distal end 114 of the shank 102. The ink tube 104 is inside the shank 102 and also comprises a straight section 164 and a bent section 166. In embodiments, the straight section 160 of the shank 102 and the straight section 164 of the ink tube 104 are coaxial along a longitudinal, central axis 170.

In accordance with aspects of the invention, the bent tubular member 110 comprises a first straight portion 172, a second straight portion 174, and a bend 176 between the first straight portion 172 and the second straight portion 174. The first straight portion 172 is arranged along axis 178, and the second straight portion 174 is arranged along axis 180. Angle 181 is defined by axis 170 and axis 178, angle 182 is defined by axis 178 and axis 180, and angle 183 is defined by axis 180 and axis 170. In embodiments, angle 182 is in a range of 45° to 90°, more preferably in a range of 45° to 67.5°, and angles 181 and 183 are designed based on the value of angle 182. In a preferred embodiment, angle 181 is about 135°, angle 182 is about 67.5°, and angle 183 is about 90°. In a preferred embodiment, all angles 181, 182, 183 are non-zero angles, and the first angle 181 is greater than the second angle 182. By configuring the pen 100 such that the angle 182 is about 45 to 90 degrees, a user holding the pen 100 in their left hand may position the writing tip relative to the writing surface in the half cone described with respect to FIG. 1.

In accordance with aspects of the invention, the shank 102, ink tube 104, tip member 106, and bent tubular member 110 are structured and arranged such that the ball 140 is located on or very close to (e.g., within 1 to 2 mils of) the central longitudinal axis 170. By configuring the pen 100 such that the ball 140 is on (or very close to) the axis 170, the problem of an off-center pivot is avoided. As such, implementations of the pen 100 permit a left handed user to drag the writing tip across the writing surface when writing from left to right with the pen in their left hand (positioning the tip for the preferred drag direction), as opposed to pushing the writing tip into the paper as is the case when writing in the same manner using a conventional pen. The same pen can be used to achieve a dragging motion (instead of a pushing motion) for a right handed person holding the pen in their right hand and moving the pen in a right to left direction across the page.

Still referring to FIGS. 8-11 and 12A-I, the pen 100 may include a cap 190 that is sized to fit simultaneously over the distal end 114 of the shank 102 and the bent tubular member 110. In embodiments, the cap 190 has an internal dimension that is substantially larger than the exterior dimension of the distal end 114 of the shank 102. The cap is designed to house the unique shape of the tip end of the pen to protect it from the elements. The clip is located on the side of the cap to permit the larger than average head size of the pen to be placed on its side so it can be clipped to s shirt pocket or any place where a pen is normally clipped.

Figure 13:
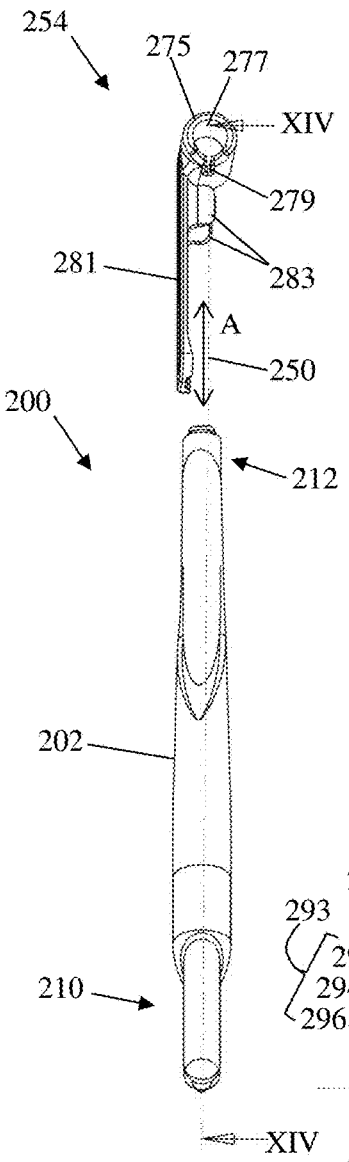
Figure 14:
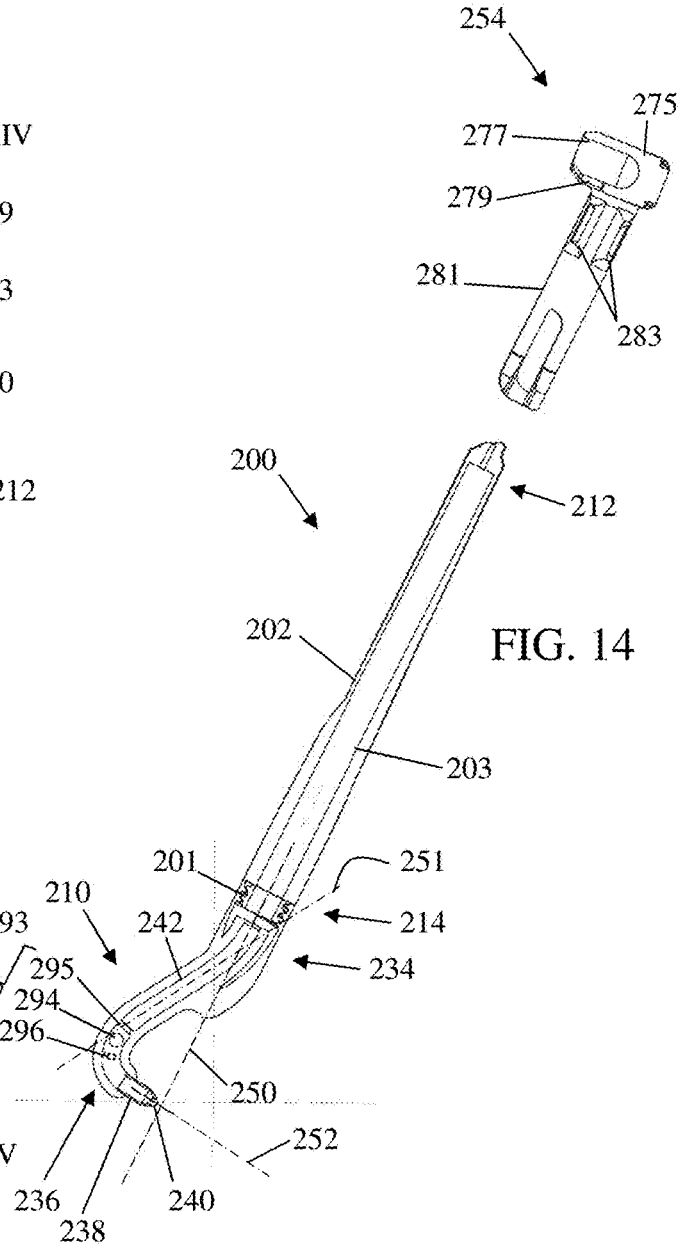
Figure 15:
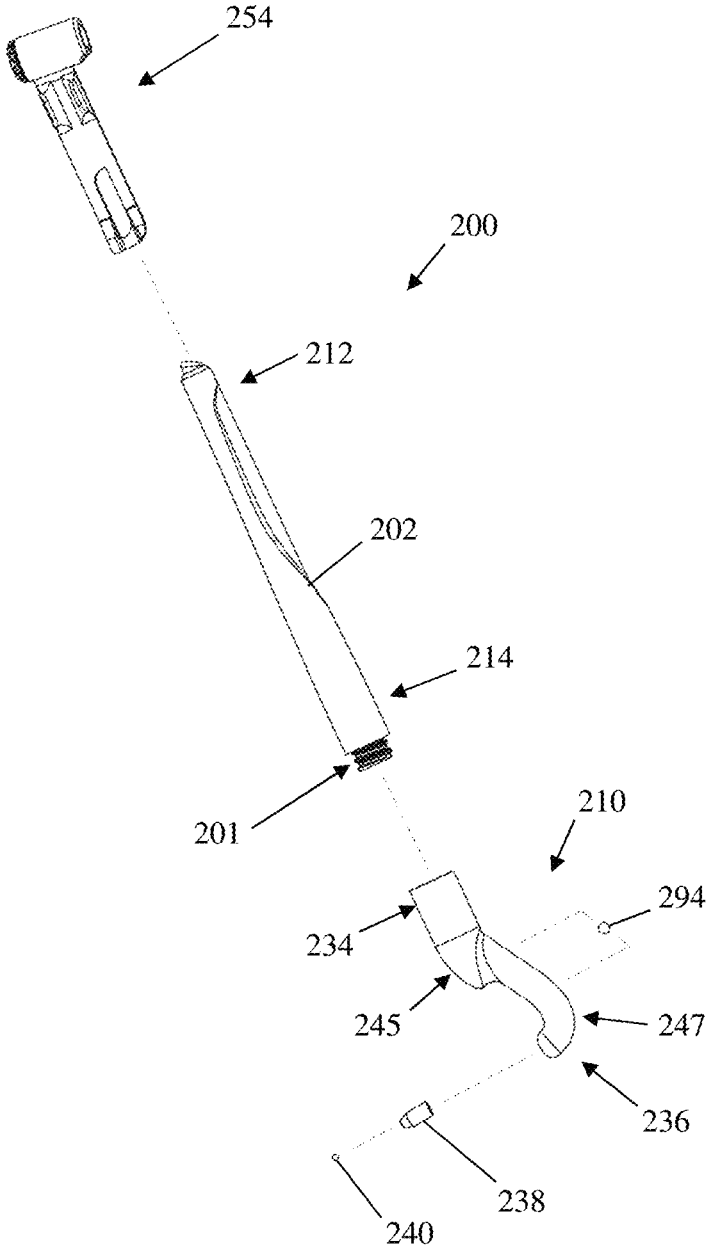

FIGS. 13-15 and 16A-J show another embodiment of a pen 200 in accordance with aspects of the invention. FIG. 13 shows a view of the pen 200. FIG. 14 is a cross sectional view along line XIV-XIV of FIG. 13. FIG. 15 is an exploded view of the pen 200. And FIGS. 16A-J show additional views of the pen.

Now referring to FIGS. 13-15, the pen 200 includes a shank 202 and a bent tubular member 210. In embodiments, the shank 202 comprises a hollow, tubular shaped body with a proximal end 212 and a distal end 214. A plug may be located and connected in the proximal end 212 of the shank 202, e.g., by friction fit or screw thread. The shank 202 comprises an internal cavity 203 that may constitute an ink reservoir that holds the ink used in writing with the pen 200. Alternatively, the internal cavity 203 may house an ink tube (e.g., similar to ink tube 4) that contains the ink used in writing with the pen 200.

In embodiments, the bent tubular member 210 comprises a hollow tubular structure having a proximal end 234 and a distal end 236. The distal end 236 comprises a socket 238 that holds a ball 240 in a conventional manner, e.g., in a ball-point or roller-ball manner. The socket 238 may be a separate piece from the bent tubular member 210 and may be affixed to the bent tubular member 210 by friction fit, press fit, adhesive, etc. The socket 238 may alternatively be integrally formed with the bent tubular member 210, e.g., as a unitary member.

As shown in FIGS. 14 and 15, the bent tubular member 210 is connected directly to the shank 202 by a connection 201. In embodiments, the connection 201 is a threaded connection, although other types of connections may be used, such as friction fit, detent, etc.

The bent tubular member 210 also includes an internal passage 242 that conveys ink from the ink reservoir or ink tube at interior of the shank 202 to the writing tip at the socket 238 and ball 240. In accordance with aspects of the invention, the internal passage 242 includes a valve 293 that affects flow of ink within the internal passage 242. In embodiments, the valve 293 comprises check valve and preferable a ball check valve that includes a ball 294, a seat 295, and at least one rail 296, although other types of valve may be used. The valve 293 permits ink flow in the direction from the shank 202 toward the distal end 236 of the bent tubular member 210 when the ball 294 is positioned against the at least one rail 296. The valve 293 prevents ink flow in the reverse direction (i.e., from the distal end 236 toward the shank 202) when the ball 294 is positioned against the seat 295.

With specific reference to FIGS. 14 and 15, according to aspects of the invention the bent tubular member 210 includes a first bend 245 near the proximal end 234 and a second bend 247 near the distal end 236. In embodiments, the first bend 245 and the second bend 247 are structured and arranged to cause the bent tubular member to have angular relationships similar to those described with respect to bent tubular member 10 in FIGS. 6A-6C. That is to say, the first bend 245 is configured such that a middle section of the bent tubular member 210 has a central axis 251 that is positioned relative to the longitudinal central axis 250 of the shank 202 at an angle that is greater than 90° and preferably in a range of 115° to 150°, and most preferably in a range of 135° to 150°. Additionally, the second bend 247 is configured such that an angle defined between the central axis 251 of the middle section of the bent tubular member 210 and a central axis 252 of the distal end 236 is in a range of 45° to 90°, and preferably in a range of 45° to 67.5°. By configuring the pen 200 with bends and angles in this manner, a user holding the pen 200 in their left hand may position the writing tip relative to the writing surface in the half cone described with respect to FIG. 1.

In accordance with aspects of the invention, the bends 245 and 247 and angles are structured and arranged such that the ball 240 is located on or very close to (e.g., within 1 to 2 mils of) the central longitudinal axis 250. By configuring the pen 1 such that the ball 240 is on (or very close to) the axis 250, the problem of an off-center pivot is avoided. As such, implementations of the pen 200 permit a left handed user to drag the writing tip across the writing surface when writing from left to right with the pen in their left hand (positioning the tip for the preferred drag direction), as opposed to pushing the writing tip into the paper as is the case when writing in the same manner using a conventional pen. The same pen can be used to achieve a dragging motion (instead of a pushing motion) for a right handed person holding the pen in their right hand and moving the pen in a right to left direction across the page.

As shown in FIGS. 13-15 and 16A-J the pen 200 may include a cap 254. In accordance with aspects of the invention, the cap 254 has two different engagement structures, a first engagement structure that is used when securing the cap 254 to the proximal end 212 of the shank 202 and a second engagement structure that is used when securing the cap 254 to the bent tubular member 210.

In embodiments, the second engagement structure comprises a cup 275 with an internal cavity 277 that is sized and shaped to snugly receive the distal end 236 of the bent tubular member 210. As shown in FIG. 16F, the cup 275 is configured to be moved onto and off of the distal end 236 of the bent tubular member 210 by moving the cap 254 in a direction that is substantially parallel to axis 252 of the distal end 236. Since the axis 252 of the distal end is arranged at angle relative to the central axis 250 of the shank 202, the cup 275 is configured to be moved onto and off of the distal end 236 of the bent tubular member 210 by moving the cap 254 in a direction that is not parallel to the to the central axis 250 of the shank 202. The cup 275 may include a groove 279 (shown in FIGS. 13, 14, and 16E) that provides friction against the surfaces of the bent tubular member 210 for holding the cap 254 in place when the cap is positioned on the bent tubular member 210.

As shown in FIGS. 13 and 14, an arm 281 extends from the cup 275. In embodiments, the first engagement structure comprises flanges 283 extending from the arm 281. The flanges 283 are sized and shaped to snugly hold the cap 254 on the proximal end 212 of the shank 202. The cap 254 is configured to be moved onto and off of the proximal end 212 of the shank 202 by moving the cap 254 relative to the shank 202 in the direction parallel to the central axis 250 of the shank 202 as indicated by arrow "A" in FIG. 13 In this manner, the cap 254 is structured and arranged to connect to the shank 202 by moving the cap 254 in a first direction relative to the shank 202 (as shown in FIG. 13) and to connect to the bent tubular member 210 by moving the cap 254 in a second direction relative to the shank 202 (as shown in FIG. 16F), where the second direction is different from the first direction.

Figure 16D:
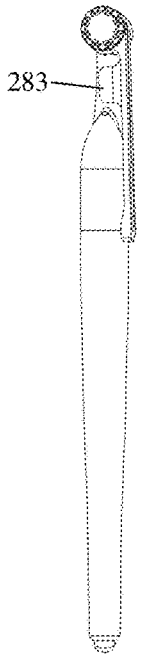
Figure 16E:
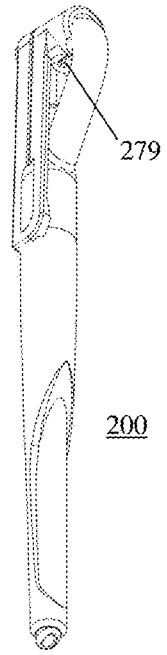
Figure 16F:
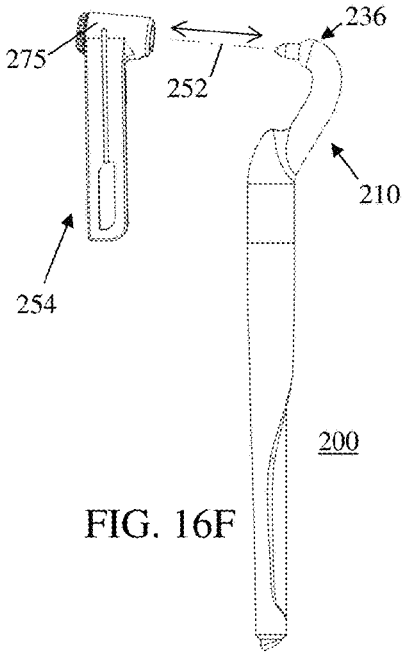
Figure 16G:
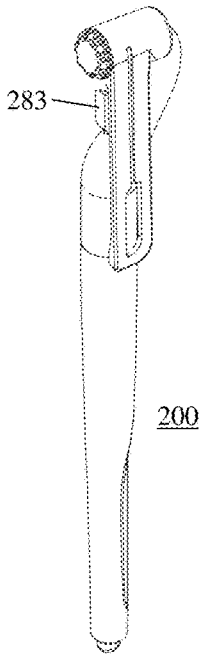
Figure 16H:
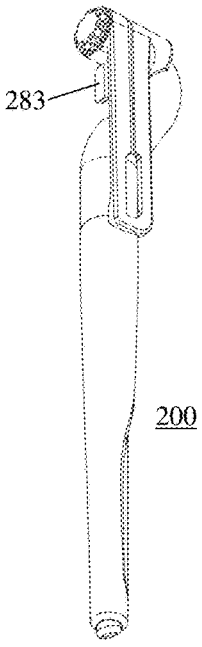
Figure 16I:
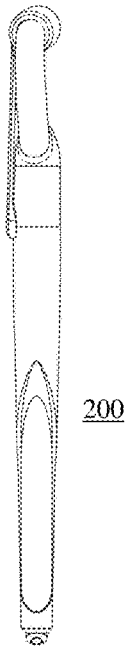
Figure 16J:
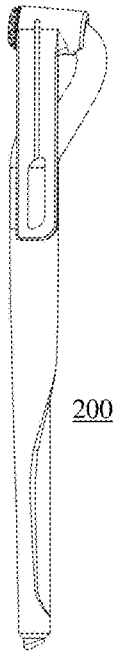

As shown in FIGS. 16D, 16G, and 16H, the cap 254 is also sized and shaped such that the flanges 283 are positioned in a space defined by the curvature of the bent tubular member 210 when the cap 254 is secured to the distal end 236 of the bent tubular member 210.

Figure 18:
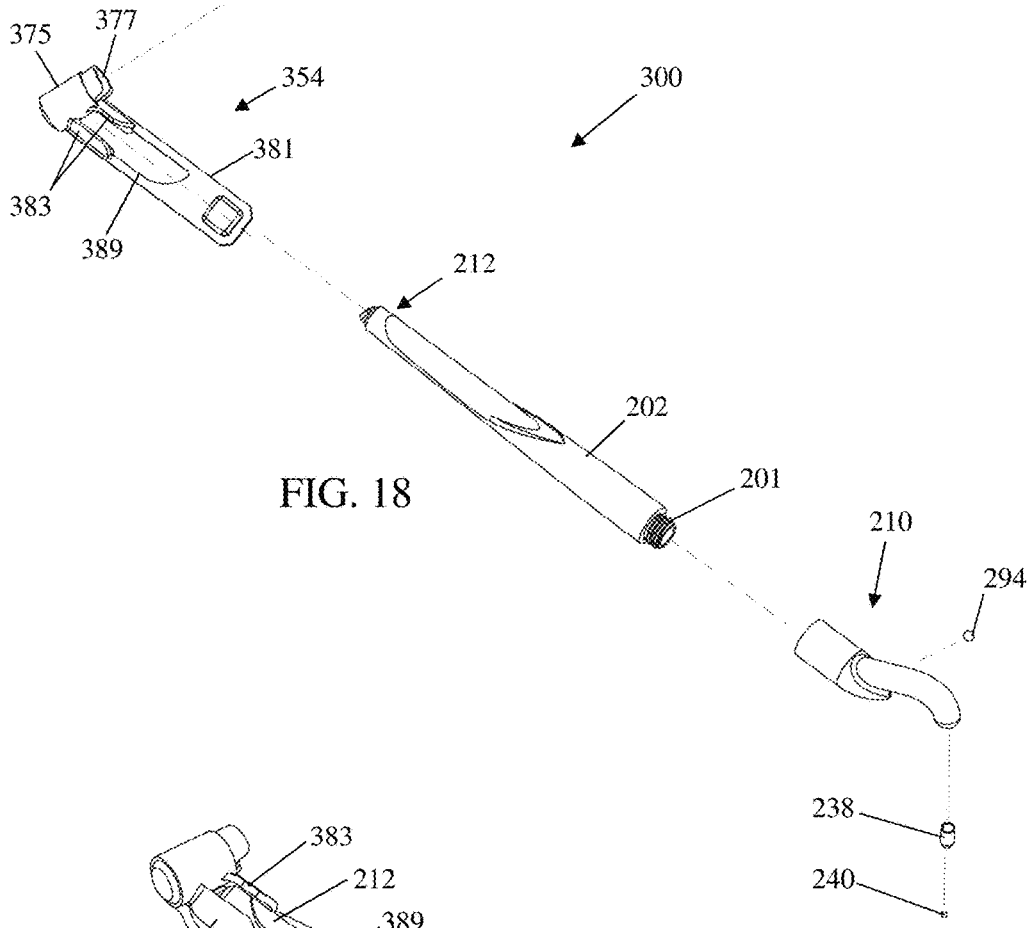
FIGS. 17-20 and 21A-D show another pen in accordance with aspects of the invention
Figure 17:
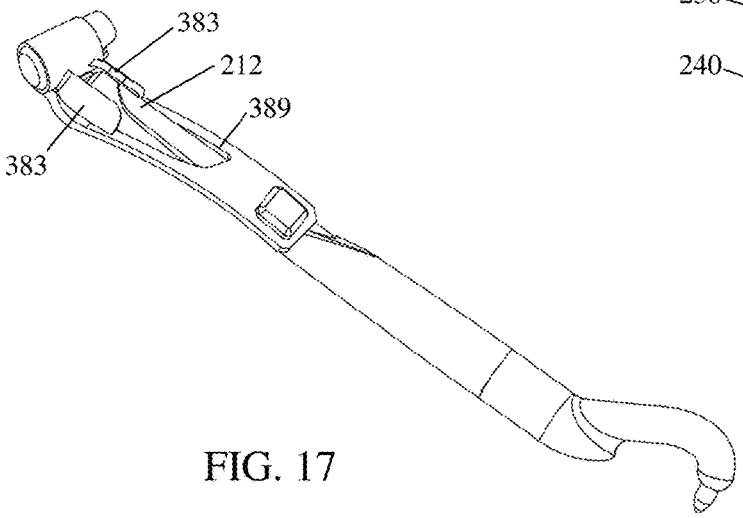
Figure 20:
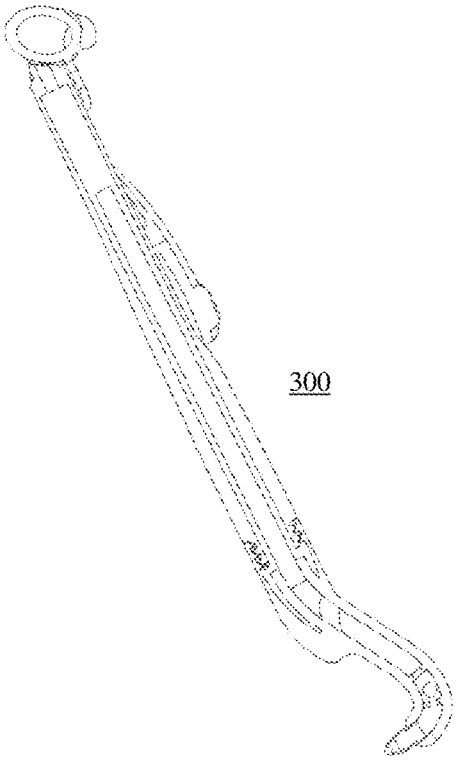
Figure 19:
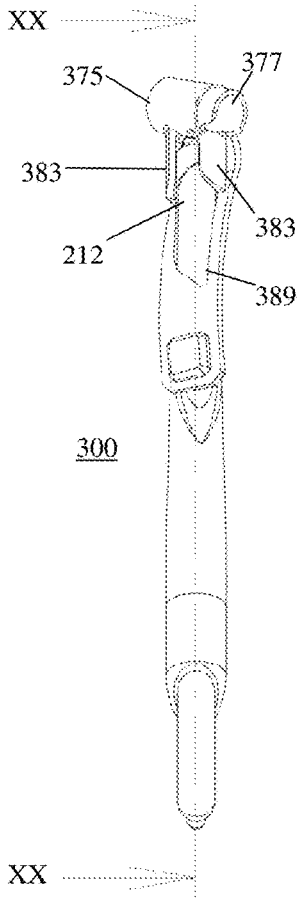
Figure 21A:
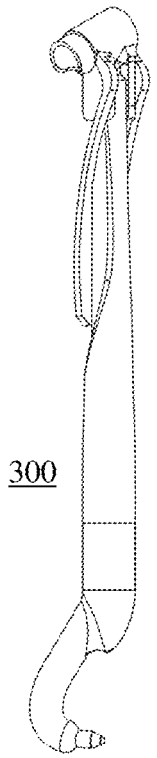
Figure 21B:
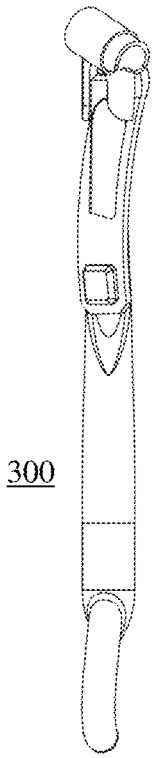
Figure 21C:
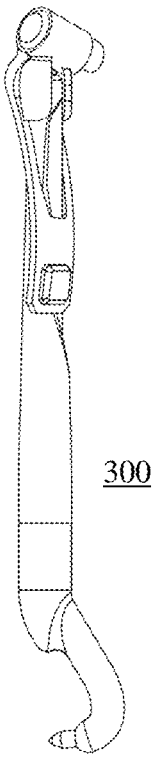
Figure 21D:
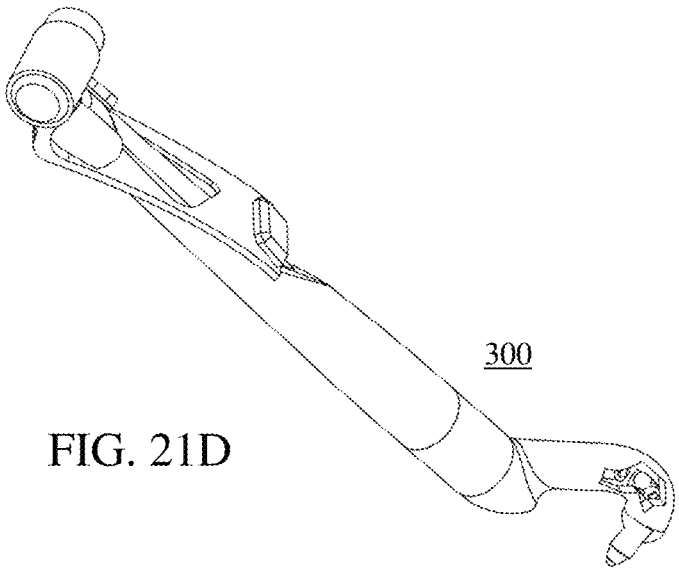

FIGS. 17-20 and 21A-D show another embodiment of a pen 300 in accordance with aspects of the invention. FIGS. 17 and 19 show views of the pen 300. FIG. 20 is a cross sectional view along line XX-XX of FIG. 19. FIG. 18 is an exploded view of the pen 200. And FIGS. 21A-D show additional views of the pen.

In embodiments, the pen 300 includes the shank 202 and bent tubular member 210 as described with respect to pen 200. The pen 300, however, has a cap 354 that differs from the cap 254 of pen 200. According to aspects of the invention, the cap 354 comprises a cup 375 with an internal cavity 377 that is configured to snugly receive the distal end 236 of the bent tubular member 210, e.g., in a manner similar to that shown with respect to cap 254 of pen 200. The cap 354 also has an arm 381 with flanges 383 that are sized and shaped to snugly hold the cap 354 on the proximal end 212 of the shank 202. In embodiments, the arm 381 has a hole 389 through which a portion of the proximal end 212 of the shank 202 extends when the cap 354 is held on the shank 202 by the flanges 383.

All embodiments are described herein using a ball at the writing tip, and the writing tip may be a ball point tip or a roller ball tip. Implementations of the invention may also utilize other types of writing tips, such as a fiber (e.g., felt) tip, instead of a ball. Pens in accordance with aspects of the invention may be configured to use any suitable type of ink, including but not limited to water based ink, oil based ink, and gel based ink.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pen, comprising:

a shank;

an ink tube inside the shank;

a first tip member connected to a distal end of the shank;

a second tip member connected to a distal end of the first tip member; and a bent tubular member comprising a proximal end section, a middle section, and a distal end section, wherein an axis of the middle section is arranged at a first angle relative to a central axis of the shank;

the axis of the middle section is arranged at a second angle relative to an axis of the distal end section, the second angle being in a range of 45° to 90°; and the axis of the distal end section is arranged at a third angle relative to the central axis of the shank.

2. The pen of claim 1, wherein the distal end section comprises a writing tip located on or very close to the central axis of the shank.

3. The pen of claim 2, wherein an axis of the proximal end section is coaxial with the central axis of the shank.

4. The pen of claim 3, wherein the ink tube is coaxial with the central axis of the shank.

5. The pen of claim 3, wherein:

the proximal end section of the bent tubular member is inside an internal bore of the second tip member; and the bent tubular member comprises a shoulder that abuts a distal end of the second tip member.

6. The pen of claim 5, wherein:

a stem of the first tip member is inside the shank;

a shoulder of the first tip member abuts the distal end of the shank;

a stem of the second tip member is inside the first tip member;

a shoulder of the second tip member abuts the distal end of the first tip member;

the ink tube passes through an internal bore of the first tip member and is connected to the stem of the second tip member; and an internal cavity of the ink tube is in fluidic communication with an internal passage of the bent tubular member via an internal bore of the second tip member.

7. The pen of claim 2, further comprising a cap that is structured and arranged to connect to the distal end of the shank by friction fit.

8. The pen of claim 1, wherein the second angle is in a range of 45° to 67.5°.

* * * * *